US005287254A

United States Patent [19]

Solman

[11] Patent Number: 5,287,254

[45] Date of Patent: Feb. 15, 1994

[54] ILLUMINATED WRITING TABLE

[76] Inventor: Richard D. Solman, 499 Main St., Apt. #1, Caribou, Me. 04736

[21] Appl. No.: 8,150

[22] Filed: Jan. 25, 1993

[51] Int. Cl.[5] ..... F21V 33/00

[52] U.S. Cl. ..... 362/98; 362/103

[58] Field of Search ..... 362/97, 98, 99, 103

[56] References Cited

U.S. PATENT DOCUMENTS

| | | | |
|---|---|---|---|
| D. 117,096 | 10/1939 | Good et al. | 362/99 |
| 1,380,895 | 6/1921 | Gilman | 362/97 |
| 2,034,529 | 3/1936 | Olsen | 362/97 |
| 2,257,005 | 9/1941 | Grosse | 362/97 |
| 3,018,107 | 1/1962 | Erickson | 362/97 |
| 3,313,514 | 4/1967 | Swett | 362/98 |
| 3,802,102 | 4/1974 | Licciardi | 362/97 |
| 4,654,762 | 3/1987 | Laverick | 362/97 |

*Primary Examiner*—Richard R. Cole
*Attorney, Agent, or Firm*—Leon Gilden

[57] ABSTRACT

An illuminated writing table includes an underlying housing having a top perimeter plate with a central opening therethrough, with the top plate having a flange to accommodate and receive a transparent light member and intermediate plate of guide lines directed therealong, whereupon writing paper positioned upon the transparent plate permits visual observation of the guide lines for providing guidance of writing in a neat and orderly manner along the paper member. Clip structure is arranged relative to the table top for securing the paper relative to the transparent plate.

1 Claim, 4 Drawing Sheets

ILLUMINATED WRITING TABLE

BACKGROUND OF THE INVENTION

1. Field of the Invention

The field of invention relates to illuminated table structure, and more particularly pertains to a new and improved illuminated writing table to provide for a guide pattern below an underlying paper to provide guidance for writing in spaced linear manner relative to the paper.

2. Description of the Prior Art

Writing tables of various types have been utilized throughout the prior art and exemplified by the U.S. Pat. Nos. 3,875,396; 4,654,762; 4,564,886; and 4,418,378.

The instant invention attempts to overcome deficiencies of the prior art that have heretofore failed to provide for illuminated writing table in association with a guide pattern readily removed and mounted relative to the table and in this respect, the present invention substantially fulfills this need.

SUMMARY OF THE INVENTION

In view of the foregoing disadvantages inherent in the known types of illuminated writing table now present in the prior art, the present invention provides an illuminated writing table wherein the same is directed to the providing of guide lines mounted within a transparent plate portion for providing guidance to the writing relative to a document. As such, the general purpose of the present invention, which will be described subsequently in greater detail, is to provide a new and improved illuminated writing table which has all the advantages of the prior art illuminated writing table and none of the disadvantages.

To attain this, the present invention provides an illuminated writing table including an underlying housing having a top perimeter plate with a central opening therethrough, with the top plate having a flange to accommodate and receive a transparent light member and intermediate plate of guide lines directed therealong, whereupon writing paper positioned upon the transparent plate permits visual observation of the guide lines for providing guidance of writing in a neat and orderly manner along the paper member. Clip structure is arranged relative to the table top for securing the paper relative to the transparent plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminated writing table which has all the advantages of the prior art illuminated writing tables and none of the disadvantages.

It is another object of the present invention to provide a new and improved illuminated writing table which may be easily and efficiently manufactured and marketed.

It is a further object of the present invention to provide a new and improved illuminated writing table which is of a durable and reliable construction.

An even further object of the present invention is to provide a new and improved illuminated writing table which is susceptible of a low cost of manufacture with regard to both materials and labor, and which accordingly is then susceptible of low prices of sale to the consuming public, thereby making such illuminated writing tables economically available to the buying public.

Still yet another object of the present invention is to provide a new and improved illuminated writing table which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
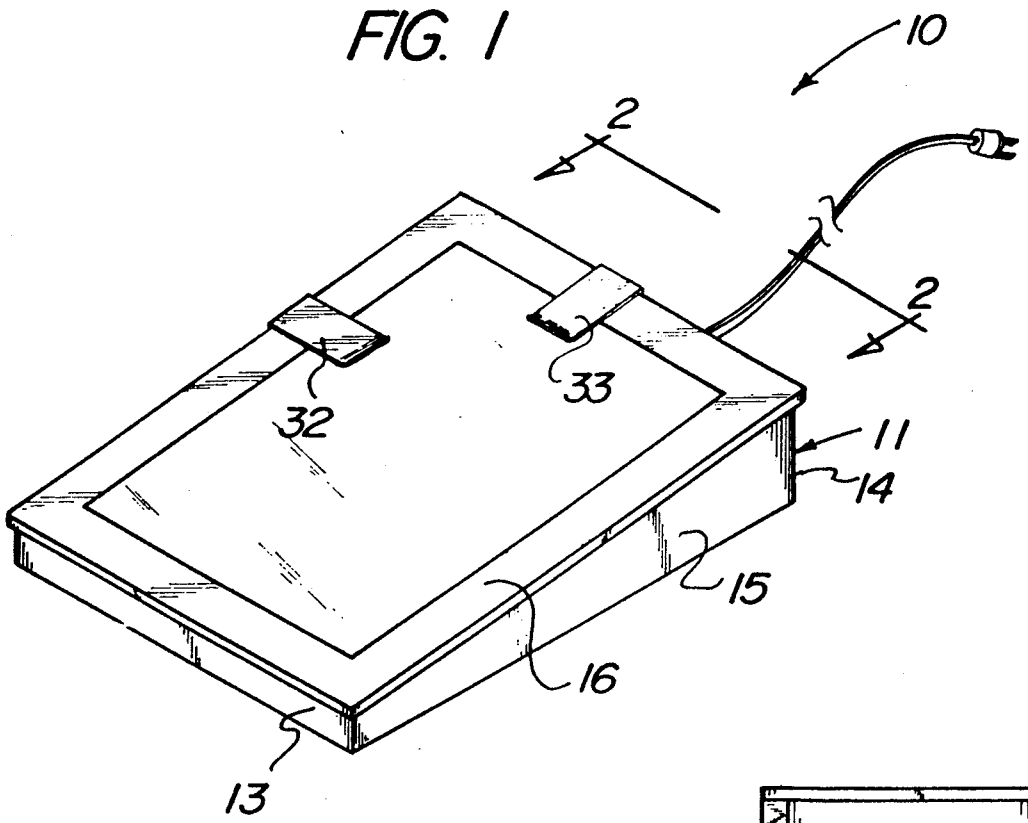
FIG. 1 is an isometric illustration of the invention.
Figure 2:
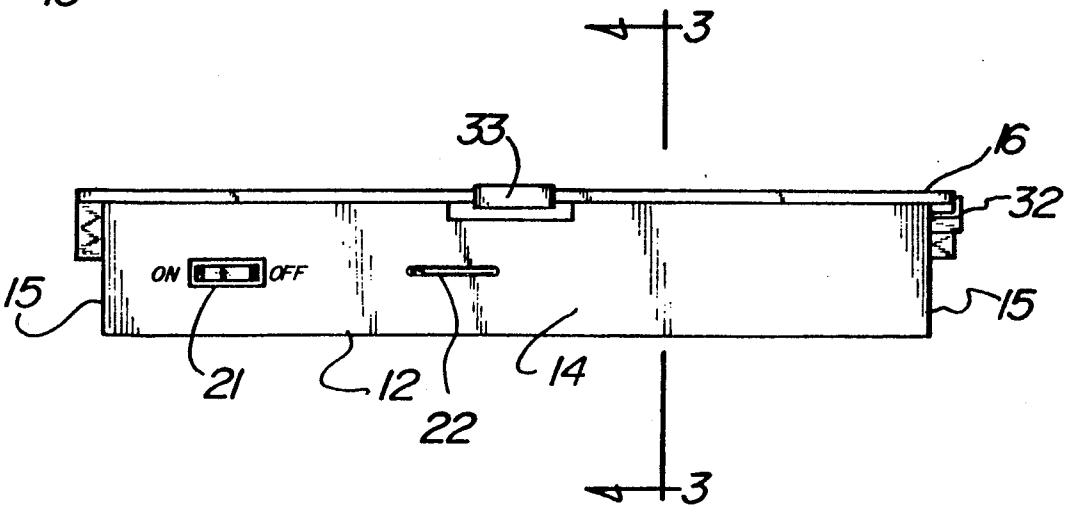
FIG. 2 is an orthographic end view of the invention, taken along the lines 2—2 of FIG. 1 in the direction indicated by the arrows.
Figure 3:
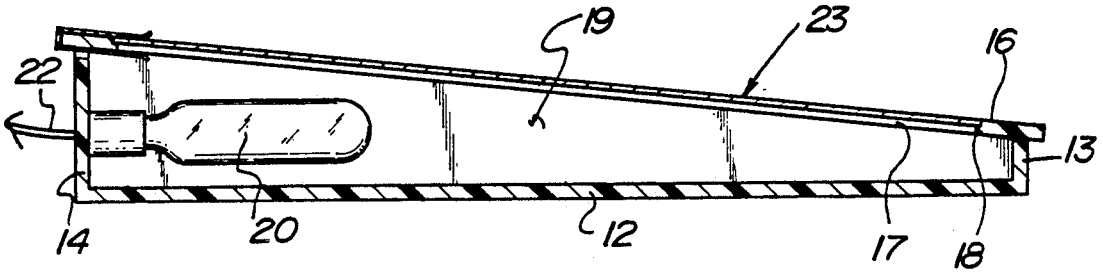
FIG. 3 is an orthographic view, taken along the lines 3—3 of FIG. 2 in the direction indicated by the arrows.
Figure 4:
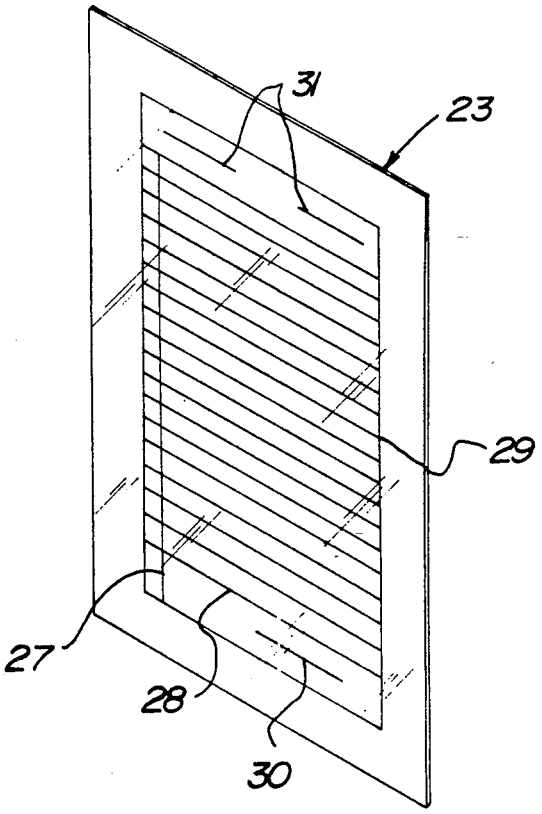
FIG. 4 is an isometric illustration of the transparent plate structure of the invention.

With reference now to the drawings, and in particular to FIGS. 1 to 9 thereof, a new and improved illuminated writing table embodying the principles and concepts of the present invention and generally designated by the reference numeral 10 will be described.

More specifically, the illuminated writing table 10 of the instant invention essentially comprises a housing 11 having a floor 12, spaced trapezoidal side walls 15, with a first end wall 13 of a first height spaced from and parallel a second end wall 14 of a second height greater than the first height to cant a top wall perimeter frame 16 from the first end wall 13 to the second end wall 14. The top wall perimeter frame 16 has a central opening 17, with a central opening flange 18 projecting into the central opening 17 from the frame 16 below the top surface of the top wall 16. A housing cavity 19 is defined within the housing 11 within the wall structure, wherein an illumination bulb 20 operative through an on/off switch 21 and an electrical power supply cord 22, or alternatively a battery supply, is illuminated, wherein a transparent plate 23 mounted on the central opening flange 18 coextensive within the central opening 17 projects illumination therethrough. A writing paper is mounted over the transparent plate 23 and secured thereto by the use of first and second spring clips 32 and 33. The first spring clip 32 is mounted to the top wall perimeter frame 16 extending over the central opening 17, and more specifically the transparent plate 23. Similarly, the second spring clip 23 mounted to the top wall perimeter frame 16 in adjacency to the second end wall 14 extends over the transparent plate to secure the writing paper or document onto the transparent plate 23. The transparent plate 23 is formed of first and second spaced transparent plates 24 and 25 in a parallel coextensive relationship, having a medial transparent plate 26 therebetween. The medial transparent plate 26 includes gauge lines to include an opaque first margin line 27 parallel to an opaque second margin line 29, with the first and second margin lines 27 and 29 positioned in a parallel relationship relative to the side walls 15. Opaque and parallel guide lines extend orthogonally between the margin lines 27 and 29. A closing line 30 may be provided, as well as an opaque heading line 31 positioned respectively below and above the guide lines 28 between the margin lines. In this manner, when illuminated, the guide lines, as well as the closing and heading lines, are visible through a paper positioned upon or such document over the transparent plate 22 to provide for guidance relative to inscribing and writing upon the document.

Figure 5:
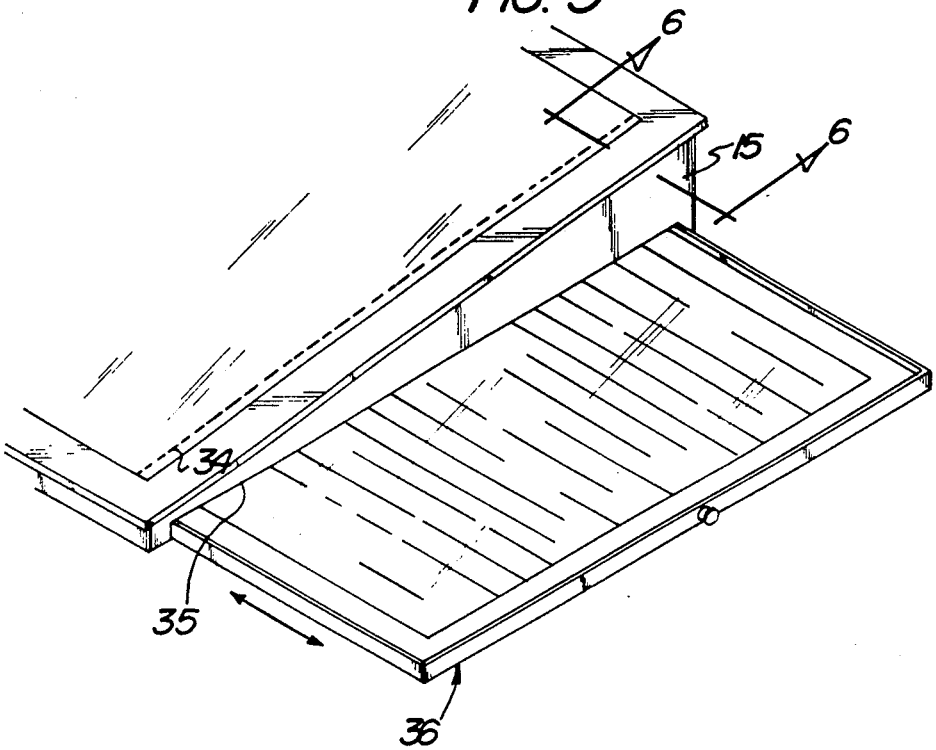
FIG. 5 is an isometric, partial view of the table structure having a replacement transparent plate removably mounted from within the table container.
Figure 6:
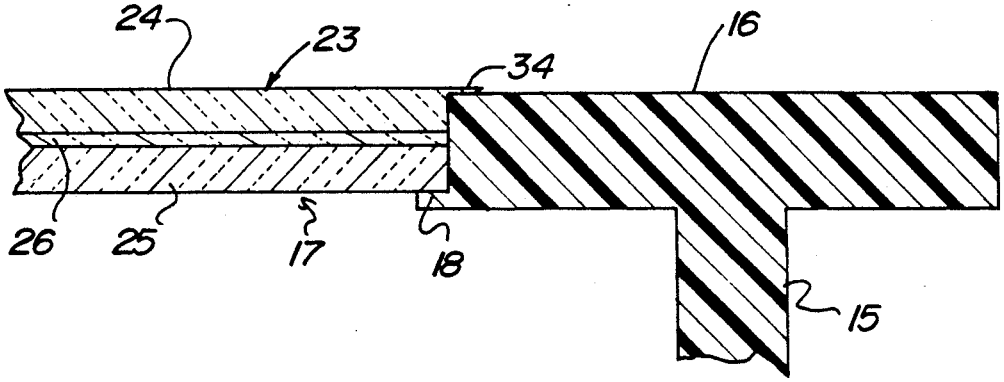
FIG. 6 is an orthographic view, taken along the lines 6—6 of FIG. 5 in the direction indicated by the arrows.

The FIGS. 5 and 6 indicates that at least the transparent plate includes a transparent plate flange 34 for projecting above the top wall perimeter frame 16 from a side of the transparent plate integral and coplanar with the first transparent plate 24 permitting ease of manual grasping of the transparent plate for its removal relative to the transparent plate and the table structure.

The FIG. 5 further indicates the use of a housing side wall opening 35 directed through one of the side walls 15 arranged to accommodate a further transparent plate 36 through the housing side wall opening 35 that may have guide lines of a differing pattern . Alternatively, flexible transparent webs may be mounted (not shown) to the plate 36 with the webs including various line patterns.

Figure 7:
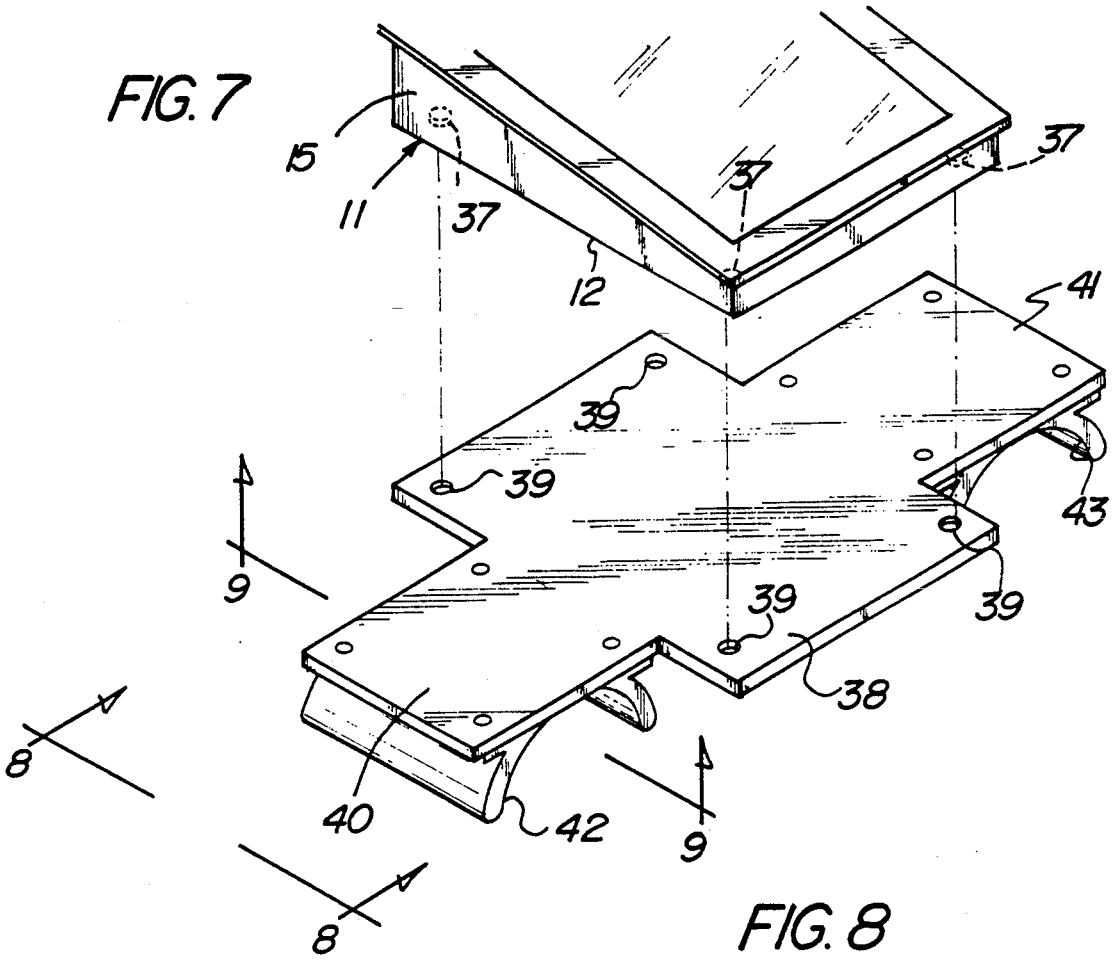
FIG. 7 is an isometric illustration of the invention employing a lap-top support structure.
Figure 8:
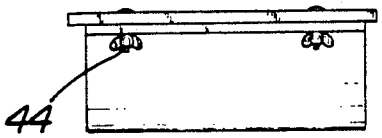
FIG. 8 is an orthographic view, taken along the lines 8—8 of FIG. 7 in the direction indicated by the arrows.
Figure 9:
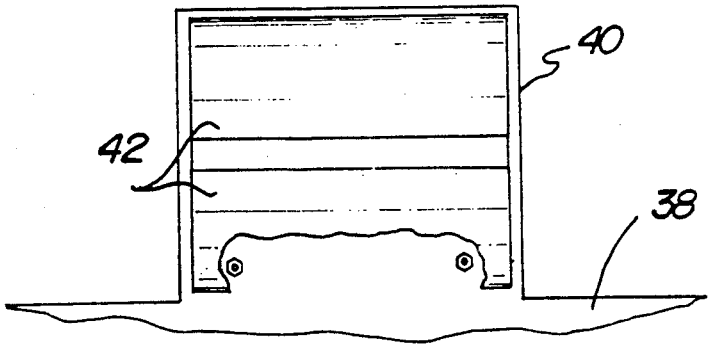
FIG. 9 is an orthographic view, taken along the lines 9—9 of FIG. 7 in the direction indicated by the arrows.

The FIG. 7 indicates the floor 12 having a plurality of floor boss members 37, typically of resilient construction, arranged for reception through lap plate openings 39 of an underlying lap plate 38. The lap plate 39 includes respective first and second wing plates 40 and 41 coplanar with the lap plate positioned on opposed sides thereof, with the first and second wing plates 40 and 41 having underlying first and second arcuate saddle members 42 and 43. The use of fastener members 44 arranged to provide for securement of the saddle members to the wing plates, wherein the saddle members have semi-cylindrical recesses arranged for positioning upon an individual's knees to provide ease of securement and mounting of the lap plate structure and associated mounting of the table structure thereon. The saddle members are typically formed of cooperative semi-arcuate members, if required, to provide the adjustment of the semi-arcuate members to space the semi-arcuate members relative to one another to provide for accommodating of knees of various widths of individuals.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An illuminated writing table, comprising, a housing, with the housing having a floor, a first end wall of a first height spaced from a second end wall of a second height, wherein the second height is greater than the first height, and spaced trapezoidal side walls, and a top wall perimeter frame mounted over the first side wall, the second end wall, and the side walls, with the top wall perimeter frame having a central opening directed therethrough, and the top wall perimeter frame canted from the second end wall towards and downwardly to the first end wall relative to the floor, wherein the central opening includes a central opening flange projecting into the central opening from the top wall perimeter frame below a top surface of the top wall, and a transparent plate is arranged for mounting upon the central opening flange coextensively within the central opening, and the housing includes a housing cavity between the top wall perimeter frame and the floor, with an illumination bulb mounted within the housing cavity, and an on/off switch directed through the housing for selective illumination of the illumination bulb, and the transparent plate includes a first transparent plate spaced from a second transparent plate, and a medial transparent plate coextensive with and medially of the first transparent plate and the second transparent plate, and the medial transparent plate having opaque first and second spaced margin lines arranged in a parallel relationship, and opaque guide lines are orthogonally directed between the first and second margin lines, and a first spring clip mounted to the top wall perimeter frame in adjacency to one of the side walls extending over the transparent plate, and a second spring clip mounted to the top wall perimeter frame extending over the transparent plate to secure a document between the first spring clip and the second spring clip relative to the first transparent plate, and one of the side walls includes a side wall opening directed therethrough, and a further transparent plate is arranged for sliding reception through the housing side wall from within the housing cavity for replacement of the plate, and a lap plate, the lap plate having a plurality of lap plate openings, and the floor having a plurality of resilient boss members, and the resilient boss members are received within the lap plate openings for mounting the housing onto the lap plate, the lap plate further including a first wing plate and a second wing plate mounted on opposed sides of the lap plate, with the first wing plate and the second wing plate coplanar with the lap plate, the first wing plate and the second wing plate including respective first and second arcuate saddle members mounted to the first wing plate and the second wing plate, wherein the first and second arcuate saddle members include respective first and second semi-cylindrical cavities for positioning the first and second arcuate saddle members upon an individual's legs.

* * * * *